US005333396A

United States Patent [19]

Kanai

[11] Patent Number: 5,333,396

[45] **Date of Patent: * Aug. 2, 1994**

[54] DRYING APPARATUS HAVING A ROTARY SPIRAL BLADE AND A BAFFLE PLATE IN OPPOSITION THERETO

[76] Inventor: Masao Kanai, 18-10 Nagatasannoudai, Minami-ku Yokohama-shi, Japan

[ * ] Notice: The portion of the term of this patent subsequent to Dec. 24, 2008 has been disclaimed.

[21] Appl. No.: 959,657

[22] Filed: Oct. 13, 1992

[30] Foreign Application Priority Data

Oct. 16, 1991 [JP] Japan ..... 3-092556[U]

[51] Int. Cl.[5] ..... F26B 17/12

[52] U.S. Cl. ..... 34/166; 34/179; 34/181; 366/310

[58] Field of Search ..... 34/147, 179, 181, 182, 34/183, 185, 166, 171–173, 93; 198/637; 432/139–142, 154; 366/310, 309, 312; 110/110

[56] References Cited

U.S. PATENT DOCUMENTS

| | | | |
|---|---|---|---|
| 2,806,298 | 9/1957 | Rossi | 34/181 |
| 3,955,554 | 5/1976 | Collie | 34/93 |
| 4,245,399 | 1/1981 | Muller et al. | 34/166 |
| 4,499,669 | 2/1985 | Haeck | 34/166 |
| 4,702,177 | 10/1987 | Narisoko et al. | 110/110 |
| 4,915,506 | 4/1990 | Sato et al. | 34/179 |
| 5,074,057 | 12/1991 | Kanai | 34/179 |

*Primary Examiner*—Denise Gromada
*Attorney, Agent, or Firm*—Cushman, Darby & Cushman

[57] ABSTRACT

A drying apparatus for removing moisture content from a substance to be dried, comprises a peripheral wall defining a working space for drying the substance, the peripheral wall defines at least an inlet for charging the substance to be dried, an outlet for taking the dried substance therefrom and a drain. A rotary spiral blade assembly is disposed within the working space and has a lower end, at which the substance accumulated on the bottom of the working space rides on a transporting surface of the rotary spiral blade assembly. The rotary spiral blade assembly is rotatable at a predetermined rotation speed sufficient for forcing the substance on the transporting surface to climb up toward the upper end of the rotary spiral blade assembly. The rotary spiral blade assembly defines a path for the substance reaching at upper end thereof to fall down to the bottom. A heating device is associated with at least one of the peripheral wall and the rotary spiral blade assembly for heating a surface interfacing with the substance, while the substance travels on the transporting surface toward the upward end. A device located in opposition to the upper end of the rotary spiral blade assembly, forces the substance reaching the upper end to fall down through the path.

16 Claims, 5 Drawing Sheets

DRYING APPARATUS HAVING A ROTARY SPIRAL BLADE AND A BAFFLE PLATE IN OPPOSITION THERETO

BACKGROUND OF THE INVENTION

1. Field of the Invention

The present invention relates generally to a drying apparatus for removing moisture from substances in liquid state, fluid state or semi-fluid state. More specifically, the invention relates to a drying apparatus having a vertically oriented rotary spiral for effectively removing moisture from the liquid state, fluid state or semi-fluid state substances.

2. Description of the Related Art

As is well known, there have been employed in various fields of industries various drying processes for drying and removing moisture from liquid state, fluid state, semi-fluid state, powder state or grain state substances. In the various sites, a variety of drying apparatus have been used.

However, in the known technologies, a drying apparatus, having high efficiency is generally only applicable for specific applications or for a specific substances. In most cases, such apparatus is not at all effective for applications other than those specified. On the other hand, there are general purpose drying apparatus which have a wide range of applicability. However, these apparatus are generally low in drying efficiency, are of complicated construction, or are facilities which require high costs to operate. No drying apparatus exists in the prior art that has a high drying efficiency and a wide range, of applicability.

The commonly owned U.S. Pat. No. 5,074,057, (the '057 patent), issued on Dec. 24, 1991 proposes a drying apparatus with a rotary spiral blade. The disclosed apparatus comprises a drying vessel to hold the moisture containing substance to be dried. The vessel has a heat conduction surface on its inner wall for transmitting heat to the substance, and a circulating rotary means to put the substance in motion in the vessel. The efficiency with which the substance can be brought to the heat conduction surface is thereby inward. The circulating rotary means comprises a rotary shaft vertically extending in the vessel in the direction of gravity, and a spiral blade integrally connected to and wound around the rotary shaft. The spiral blade has a flat upper surface, whereby rotation of the rotary shaft and hence the spiral blade causes the substance to rise up in the direction opposite of gravity. The substance slides on the flat upper surface of the spiral blade as it is being raised until the substance falls down in the direction of gravity through a falling space which is defined in the drying vessel, or until the substance comes in contact with the heat conduction surface.

With the construction set forth above, the moisture containing substance is put in the drying vessel, and then the substance is located at the lower position, under the influence of gravity. The heat conduction surface of the drying vessel is heated so that the heat is transferred to the moisture containing substance in the drying vessel. The spiral blade rotates about its axle. In the case where the spiral blade is hollow, a heating medium is led into the inside of the spiral blade, to heat the upper surface of the spiral blade so that it will also function as a heat conduction surface just like the inner wall of the drying vessel.

The moisture containing substance circulates in the '057 patent, at an increased speed and brings the substance into contact with the heat conduction surface of the drying apparatus at an increased efficiency. Thus, this drying apparatus achieves both a high drying efficiency and a wider range of application. However, there is still room for improvement in the '057 patent.

For example, in the prior proposed invention, the moisture containing substance is transported from the lower portion of the drying vessel, toward the upper portion, on the flat upper surface of the spiral blade, which also serves as a part of the heat condition surface. The substance travelling along the flat upper surface of the spiral blade forms a thin film contacting with the heat conduction surface for promoting heat transfer from the heat conduction surface to the substance. As set out above, in the construction set forth above, for obtaining a satisfactorily level of removal of the moisture from the substance, it is necessary to smoothly shift the substance along the flat upper surface of the spiral blade. To achieve this, the substance approaching the upper portion of the drying vessel needs to fall down from the spiral blade to repeat the heating cycles.

The present invention is thus intended to provide an improvement for applicant's prior invention so as to achieve a smooth circulation of the moisture containing substance and to assure that the substance will fall down once it reaches the top end of the spiral blade.

SUMMARY OF THE INVENTION

Therefore, it is an object of the present invention to provide an improved drying apparatus which can assure a smooth circulation of a moisture containing substance, thereby enhancing the drying efficiency.

Another object of the present invention is to provide a drying apparatus having a spiral blade for transferring the substance upwardly, while ensuring that the substance will fall down when it reaches the top of the spiral blade.

According to one aspect of the present invention, a drying apparatus for removing moisture content from a substance to be dried, comprises:

a drying vessel to contain the substance, the vessel having a heat conduction surface on its inner wall for transmitting heat to the substance;

circulating rotary device for moving the substance within the vessel, thereby increasing the efficiency with which the substance can be brought into contact with the heat conduction surface, the circulating rotary device including:

a rotary shaft vertically extending in the vessel in the direction of gravity, and a spiral blade integrally connected to and wound around the rotary shaft, the spiral blade having a flat upper surface, a hollow space within that permits a heating medium to flow inside the hollow space of the spiral blade, whereby rotation of the rotary shaft and hence the spiral blade, causes the substance to rise up in the direction opposite of gravity while sliding on the flat upper surface of the spiral blade and the substance may come into contact with the heat conduction surface while being circulated in the drying vessel; and a device provided in opposition to the upper end of the flat upper surface of the spiral blade for forcing the substance off the upper end of the flat upper surface to fall down through a falling space defined by the circulating rotary spiral blade.

According to another aspect of the invention, an apparatus for removing the moisture content from a substance to be dried comprises:

a vessel for containing the substance, the vessel having a heating wall capable of transferring heat from a heating medium to the substance; and a device for moving the substance inside the vessel including:

a rotary shaft vertically extending inside the vessel, and a spiral blade of a given length connected to and wound around the rotary shaft, for transporting the substance near the bottom of the vessel to near the top of the vessel, the spiral blade having a flat upper surface and having an outer edge forming a gap with the heating wall; and a device provided in opposition to the upper end of the flat upper surface of the spiral blade for forcing the substance off the upper end of the flat upper surface to fall down through a falling space defined in part by the circulating rotary spiral blade.

The device for forcing the substance off the upper end of the spiral blade preferably comprises a baffle plate provided in opposition with the upper end of the spiral blade with a given angular relationship thereto. The baffle plate may be provided in direct contact with the inner wall of the drying vessel.

According to a further aspect of the invention, a drying apparatus for removing moisture content from a substance to be dried, comprises:

a peripheral wall that in part defines means defining a working space for drying the substance. The peripheral wall includes an inlet for charging the substance to be dried, an outlet for taking the dried substance therefrom and a drain;

a rotary spiral blade assembly disposed within the working space and having a lower end, at which the substance accumulated on the bottom of the working space rides on a transporting surface of the rotary spiral blade assembly, the rotary spiral blade assembly is rotatable at a predetermined rotation speed that is sufficient for forcing the substance on the transporting surface to climb up toward the upper end of the rotary spiral blade assembly, and the rotary spiral blade assembly, in part defining a path for the substance which reaches the upper end thereof to fall down to the bottom;

a heating device associated with at least one of the peripheral wall and the rotary spiral blade assembly for heating a surface interfacing with the substance while the substance travels on the transporting surface toward the upward end; and a device located in opposition to the upper end of the rotary spiral blade assembly for forcing the substance reaching the upper end to fall down through the path.

According to a still further aspect of the invention, a drying apparatus for removing moisture content from a substance to be dried, comprises:

a peripheral wall that defines a working space for drying the substance, the peripheral wall including at least an inlet for charging the substance to be dried, an outlet for taking the dried substance therefrom and a drain;

a rotary device disposed within the working space for defining an upward traveling path along which the substance travels from the bottom toward the upper end thereof by the action of force induced by rotation thereof, the upward traveling path having a lower end, at which the substance accumulated on the bottom of the working space rides thereon, the rotary device being rotatable at a predetermined rotation speed that is sufficient to force the substance on the transporting surface to climb up toward the upper end of the upward traveling path, and the rotary device defines a falling down path to allow the substance which reaches at the upper end thereof to fall down to the bottom;

a heating device associated with the peripheral wall and the rotary means for heating surfaces interfacing with the substance while the substance travels on the upward traveling path; and a device located in opposition to the upper end of the upward traveling path for forcing the substance reaching the upper end to fall down through the falling down path.

The device for forcing the substance to fall down preferably includes a mechanical obstruction for interfering with the upward travel of the substance. The mechanical obstruction may be placed in proximity with the transporting surface with a necessary minimum clearance therebetween and extends across the transporting surface. The mechanical obstruction is preferably a baffle plate. In a preferred embodiment, the heating means heats at least the peripheral wall and the baffle plate is directly mounted on the peripheral wall.

BRIEF DESCRIPTION OF THE DRAWINGS

The present invention will be understood more fully from the detailed description given herebelow and from the accompanying drawings of the preferred embodiment of the invention, which, however, should not be taken as limiting to the present invention, but are merely exemplary and are for explanation and understanding only.

In the drawings.

DESCRIPTION OF THE PREFERRED EMBODIMENT

The entire disclosure of the above-identified commonly owned U.S. Pat. No. 5,074,057, issued on Dec. 24, 1991, is hereby incorporated by reference.

Figure 1:
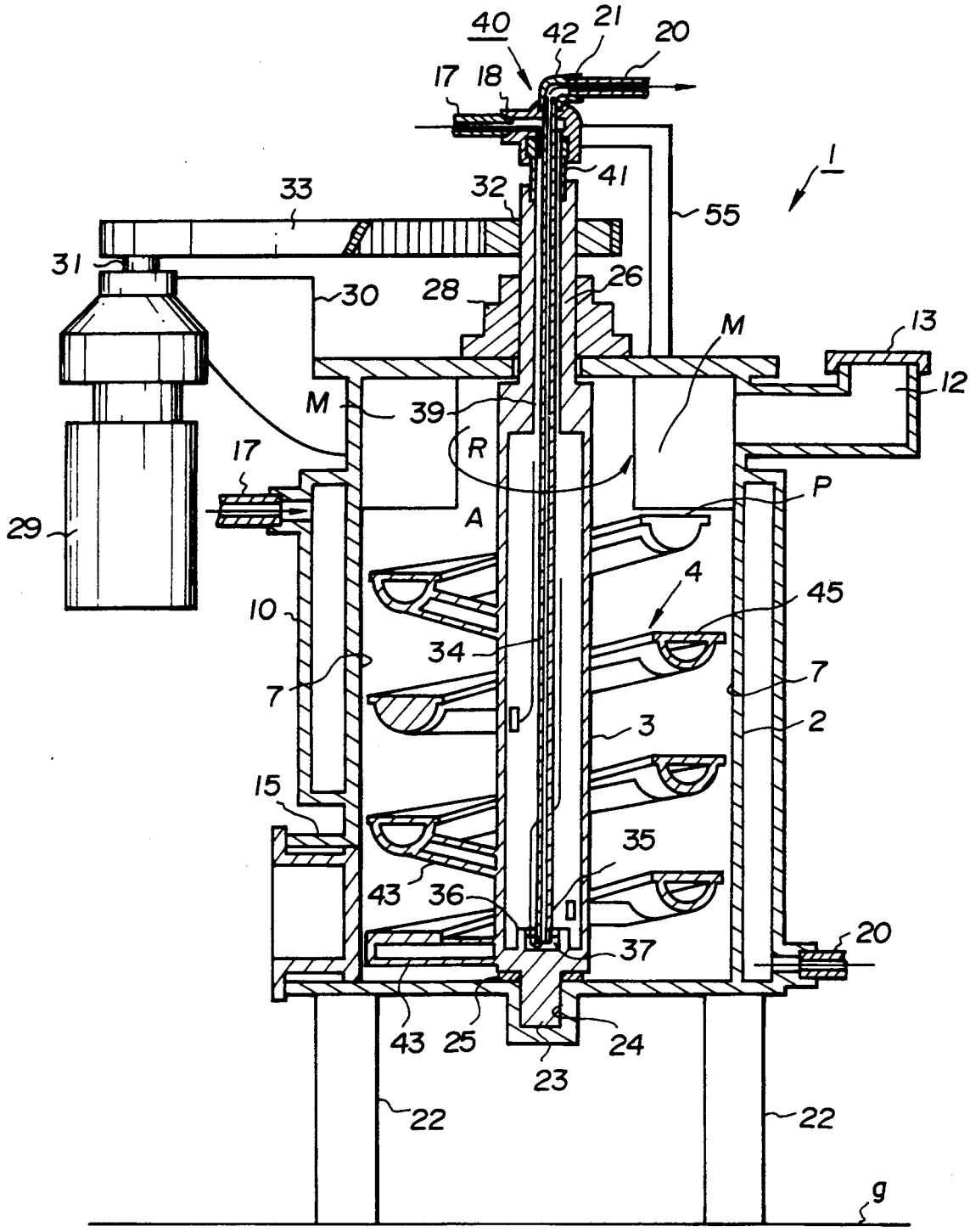
FIG. 1 is a longitudinal section of the preferred embodiment of a drying apparatus according to the present invention.
Figure 2:
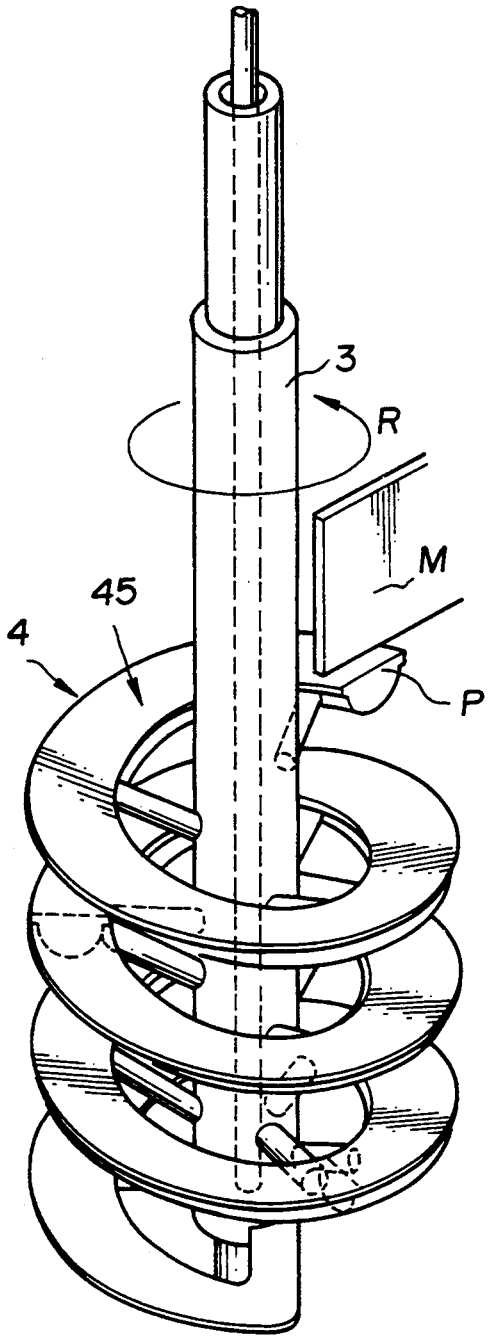
FIG. 2 is a partial perspective view showing a relationship between a rotary spiral blade and a baffling plate employed in the preferred embodiment of the drying apparatus of FIG. 1.

Referring now to the drawings, particularly to FIG. 1, the preferred embodiment of a drying apparatus 1, according to the present invention, has an essentially cylindrical drying vessel 2. The drying vessel 2 is supported by a plurality of legs 22 on a floor g so that the longitudinal axis thereof is oriented substantially in the vertical direction or the direction of gravity. A jacket 10 is arranged on the outer circumference of the drying vessel 2. The jacket 10 defines a heating chamber 10*a* for introducing a heating medium, such as a steam, heated fluid, etc., thereinto for heating the side wall of the drying vessel 2. In the preferred embodiment, steam is introduced into the heating chamber 10*a* from a boiler. The heat of the heating chamber 10*a* is thus transmitted to the side wall of the drying vessel 2. Therefore, the inner wall surface of the drying vessel 2 serves as a heat conduction surface 7. Although the shown embodiment is constructed to introduce the heating medium. Into the heating chamber 10*a* defined between the outer periphery of the drying vessel 2 and the jacket 10, it can be replaced with various heating devices that are appropriate for heating the side wall of the drying vessel. For example, the jacket may be replaced with an electric heater, a combustion type heater, an induction type heater or so forth, for directly heating the side wall of the drying vessel. Furthermore, alternative heating devices, such as an electric heating wire or an induction heating element within the side wall of the drying vessel, may be used to heat the heat conduction surface.

In the embodiment shown, the jacket 10 is provided with a steam inlet 18, which is connected to piping 17, and is connected to the boiler (not shown). The jacket 10 also has a drain outlet 21 for draining any condensed water in the heating chamber. The drain outlet 21 is connected to drain piping 20. A charge opening 12 is formed in the vicinity of the top end of the drying vessel 2 for or loading liquid state, fluid state, semi-fluid state, powder state or grain state substances to be dried by removing the moisture therein. The charge opening 12 is closed by a closure lid 13. Also, an outlet opening 15 is formed at the lower portion of the drying vessel 2 for removing the dried product.

A circulating device for circulating the moisture containing substance to be dried, is provided within the interior space of the drying vessel 2. In the preferred embodiment, the circulating device comprises a spiral blade assembly which is of substantially the same construction as that disclosed in the commonly owned, above-identified U.S. Pat. No. 5,075,057. Namely, the spiral blade assembly includes a rotary shaft 3 extending vertically substantially along the longitudinal axis of the drying vessel 2. A spiral blade 4 is rigidly mounted about the rotary shaft 3 for rotation therewith.

The lower end of the rotary shaft 3 is received within a boss 24 via a thrusting washer 25. The upper end of the rotary shaft 3 extends through an opening of a top end wall of the drying vessel 2. Outside of the drying vessel 2, the rotary shaft 3 is rotatably receive, in a bearing 28, for permitting free rotation in a direction indicated by an arrow R. The rotary shaft 3 is rotatably driven by an electric motor 29. The motor 29 is rigidly secured on the drying vessel 2 via a mounting piece 30. The motor 29 has an output shaft 31, on which a drive gear (not clearly shown) is rigidly secured. The drive gear is coupled with a driven gear 32 that is rigidly secured on the rotary shaft 3 by a geared belt or cogged belt 33 for transmitting the output torque of the motor 29. Therefore, the rotary shaft 3 is rotatably driven by the output torque of the motor 29.

It should be noted that the specific power train construction shown for the rotary shaft is merely an example, and, of course, of any appropriate construction depending upon the application. For instance, a reduction gear assembly or step-up gear assembly may be interposed between the motor and the rotary shaft, as required. Also, the electric motor may be replaced with any other driving power source, such as a combustion type drive power source, steam type power source or so forth.

In the embodiment shown, the rotary shaft 3 is formed of a hollow tubular construction. A siphon drain tube 34 is inserted through the interior space thereof. The siphon drain tube 34 is loosely received within a recess 37 formed in a siphon tube receptacle 36. The lower end of the siphon drain tube 34 and the recess 37 of the siphon tube receptacle 36 are so dimensioned that the lower end of the siphon drain tube 34 may not contact the inner periphery of the recess 37. The upper portion of the siphon drain tube 34 extends through the upper narrower opening portion 39 of the rotary shaft 3 to upwardly project therefrom. To the upper end of the upper end portion of the rotary shaft 3, a rotary connecting portion 41 of a locky joint 40 is connected. Also, the upper end of the siphon drain tube 34 is connected to the locky joint 40. Furthermore, the piping 17 connected to the boiler is connected to the locky joint 40 for introducing steam as a heating medium. In addition, the drain piping 20 is connected via a joint 42. The steam entering through the piping 17 is introduced into an annular space defined between the inner periphery of the rotary shaft 3 and the outer periphery of the siphon drain tube 34. The condensed water in the hollow interior space of the rotary shaft 3 is drained through the siphon drain tube 34 and the drain piping 20.

It should be noted that although the embodiment shown is constructed to introduce the heating medium, into the interior space of the spiral blade, it can be replaced with various heating devices that are appropriate for heating the upper surface 45 of the spiral blade. For example, the lower part of the spiral blade may be replaced with an electric heater or so forth. Furthermore, it may also be possible to incorporate a heating device, such as an electric heating wire or an induction heating element within the member forming the upper surface 45 of the spiral blade.

It should be noted that the locky joint 40 is rigidly secured to the drying vessel 2 by a mounting piece 55.

In the embodiment shown, the spiral blade 4 is formed of a hollow construction with essentially a semi-circular cross section. The spiral blade 4 is oriented so that the upper plane 45 is formed with the flat plane extending diametrically in the semi-circular cross section of the hollow spiral blade 4. The spiral blade 4 is rigidly supported on the rotary shaft 3 by a plurality of supporting arms 43 extending substantially in the radial direction. The outer periphery of the spiral blade 4 is positioned in the vicinity of the inner periphery of the drying vessel while maintaining the minimum possible clearance necessary for permitting the spiral blade 4 to rotate without conflicting with the inner periphery of the drying vessel 2. On the other hand, the inner periphery of the spiral blade 4 defines an annular space A between the outer periphery of the rotary shaft 3. The annular space A defined between the inner periphery of the spiral blade 4 and the outer periphery of the rotary shaft 3 serves as a path for the substance falling down to the bottom of the drying vessel.

The supporting arms 43 are formed of a hollow construction. The inner ends of the interior spaces of the supporting arms 43 communicate with the interior space of the rotary shaft 3. The outer ends of the interior spaces of the supporting arms 43 communicate with the interior space of the spiral blade 4. Therefore, the steam entering into the interior space of the rotary shaft 3 is introduced into the interior space of the spiral blade 4 to heat the spiral blade 4. Therefore, the flat upper surface 45 of the spiral blade 4 may serve as a heat conduction surface for transmitting the heat to the moisture containing substance traveling upwardly thereon.

It should be noted that although the embodiment shown is constructed to introduce the heating medium; into the interior space of the spiral blade, it can be replaced with various heating devices that are appropriate for heating the upper surface 45 of the spiral blade. For example, the lower part of the spiral blade may be replaced with an electric heater or so forth. Furthermore, it may also be possible to incorporate heating devices, such as an electric heating wire or an induction heating element within the member forming the upper surface 45 of the spiral blade. Furthermore, although the embodiment shown is constructed to establish steam communication through all of the supporting arms, it may be possible to establish steam communication between the interior space of the rotary shaft and the interior space of the spiral blade through only a limited number of supporting arms.

Figure 4:
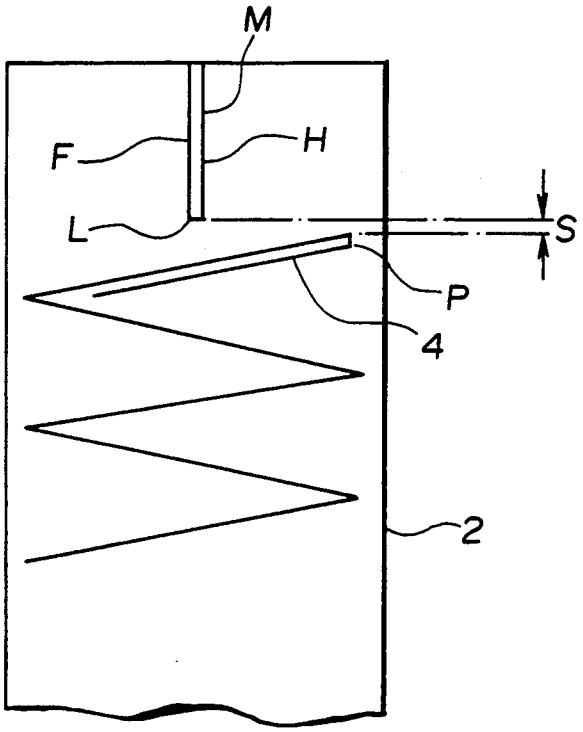
FIG. 4 is a diagrammatic illustrated side elevation showing dimensional relationship of the baffling plate relative to the spiral blade.
Figure 5:
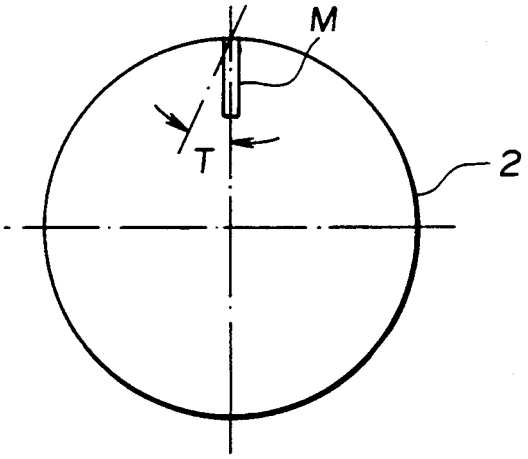
FIG. 5 is a diagrammatic illustrated plan view showing dimensional relationship of the baffling plate relative to the spiral blade.
Figure 6:
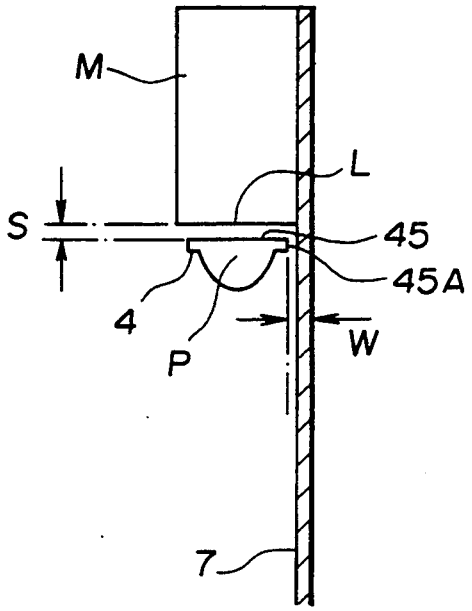
FIG. 6 is a diagrammatic illustrated enlarged partial section showing dimensional relationship of the baffling plate relative to the spiral blade.
Figure 7:
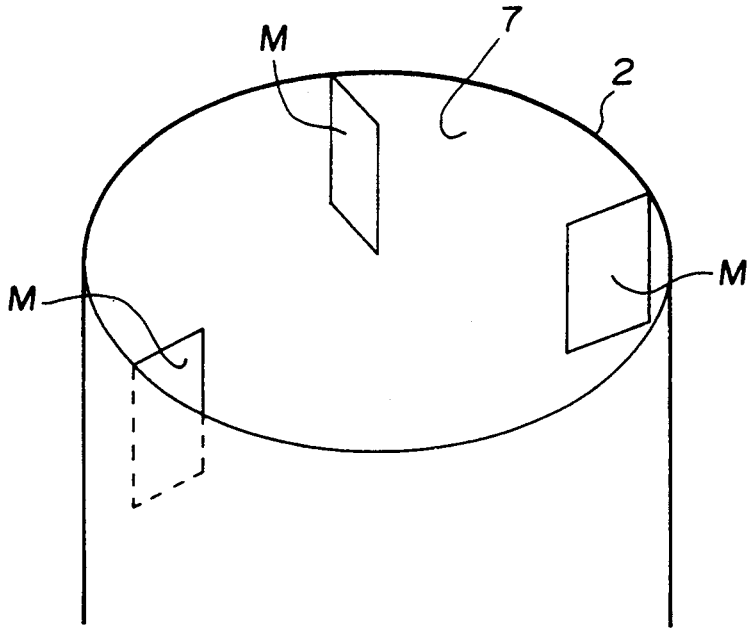
FIG. 7 is a fragmentary perspective view showing a modification of the preferred embodiment of the drying apparatus, in which three baffling plates are provided.

In addition to the construction set forth above, the embodiment shown, of the drying apparatus is provided with baffle plates M in order to achieve a smooth circulation of the substances to be dried. As seen, the baffle plates M, extend from the upper end portion of heat conduction surface 7 of the side wall of the drying vessel. The lower edges of the baffle plates M are placed in close proximity to the uppermost end of the flat upper surface 45 of the spiral blade 4 with a minimum possible clearance S. The number of the baffle plates M is not limited and can be of any number depending upon the application and necessity. For instance, in the example of FIG. 1, a pair of baffle plates M are arranged in radially symmetric positions. On the other hand, in the examples of FIGS. 3–5, only one baffle plate M is provided, and in the example of FIG. 7, three baffle plates M are arranged with a regular angular interval. The configuration of the baffle plate can be selected in any way and is not limited to the rectangular configuration as shown.

The clearance S to be provided between the lower end L and the uppermost end of the upper surface 45 of the spiral blade 4 can be selected in a range between 0.01 mm to 50 mm depending upon the kind, nature, grain or particle size of the substance to be dried. The installation angle of the baffle plate M is not limited to vertical, as illustrated, and can be oblique relative to the vertical plane. In the later case, the obliquity or inclination angle of the baffle plate may be selected depending upon the kind, nature, grain or particle size of the substance to be dried. Also, the orientation of the baffle plate M is not limited to the radial direction, as illustrated, but can be of various angles as shown by angle T in FIG. 5.

In operation, the rotary shaft 3 is rotated to by drive motor 29. The spiral blade 4, which is integrally connected to the rotary shafts is thus rotated in the direction R at a predetermined rotation speed. Then, due to the static inertia moment, the substance to be dried rides on the upper surface 45 of the spiral blade 4. Centrifugal forces and the static inertia moment act on the substance to force the substance to slidingly climb up along the upper surface 45 of the spiral blade 4 at a speed lower than the rotation speed of the spiral blade 4. During the upward travel, the substance is spread into a thin film form to maximize the area interfacing with the heated upper surface 45, which serves as a heat conduction surface. Also, due to the centrifugal force induced by high speed rotation of the spiral blade, the substance is also forced outwardly to form an interfacing layer with the inner periphery of the drying vessel 2 a which also serves as a heat conduction surface. This provides additional interface area between the substance and the heat conduction surfaces for promoting removal of moisture from the substance by effective heat transmission. Since the outer periphery of the spiral blade 4 is placed in opposition to the inner periphery of the drying vessel with a minimum clearance W, e.g. 0.01 mm to 20 mm which is selected depending upon the kind, nature, grain or particle size of the substance to be dried, the substance may not fall down from the outer periphery of the spiral blade 4.

Figure 3:
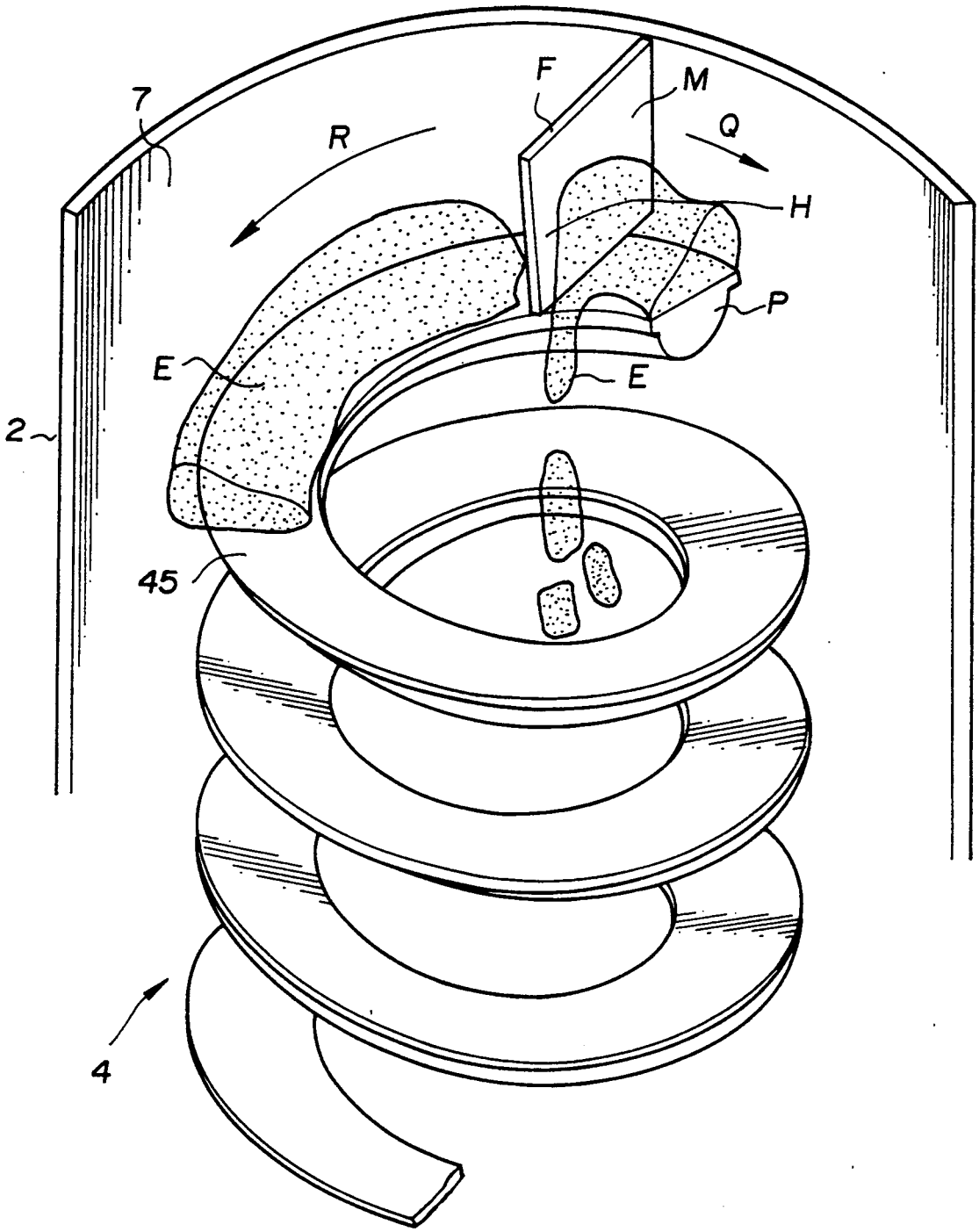
FIG. 3 is a partial perspective view showing the operation of the baffling plate for scraping down a substance to be dried at the top of the spiral blade.

The substance E eventually reaches the position in the vicinity of the upper end P of the upper surface 45, as shown in FIG. 3. Then, the substance E initially contacts on one surface F of the baffle M. Then, part of the substance E is scraped off and falls down through the clearance A. The remaining substance E passes through the clearance S between the upper surface 45 of the spiral blade 4 and the lower edge L of the baffle M to reach the upper end P. Since the climbing up speed of the substance E on the upper surface 45 of the spiral blade 4 is lower than the rotation speed of the spiral blade 4, the substance E may be accumulated at the upper end P. However, by further rotation of the spiral blade 4, the substance E accumulated at the upper end P contacts with the surface H of the baffle plate M and is scraped off to fall down to the bottom of the drying vessel 2.

With the construction shown, the upward travel of the substance contacting with the heat conduction surfaces will not be blocked by accumulation of the substance on the spiral plate. Thus, the substance is smoothly circulated in the drying vessel. By this, substantial improvement in the moisture removing efficiency can be achieved.

As set forth above, the present invention achieves a substantial and useful improvement in the drying apparatus employing the rotary spiral blade. Also, since the construction of the baffle plate is very simple, the improvement proposed by the present invention can be easily applied to any existing apparatus without requiring substantial increase of the cost for the facility.

While the present invention has been discussed in detail in terms of the preferred embodiment of the invention, the invention can be implemented in various fashion with incorporating various modifications, additions, or omissions. Therefore, it should be understood that the present invention includes all possible implementations and embodiments which are embodied without departing from the invention.

What is claimed is:

1. A drying apparatus for removing moisture content from a substance to be dried, comprising:

a drying vessel to contain said substance, said vessel having an inner wall, a heat conduction surface on said inner wall for transmitting heat to said substance;

circulating rotary means for moving said substance within said vessel, thereby increasing the efficiency with which said substance can be brought into contact with said heat conduction surface, said circulating rotary means including:

a rotary shaft vertically extending in said vessel in the direction of gravity, and a spiral blade integrally connected to and wound around said rotary shaft, said spiral blade having a flat upper surface, on which said substance is conveyed from the lower end of said spiral blade to the upper end thereof, and means for permitting heating medium to flow inside the hollow space of said spiral blade, whereby rotation of said rotary shaft and hence said spiral blade may cause said substance to rise up in the direction of gravity while sliding on said flat upper surface of said spiral blade and said substance may come in contact with said heat conduction surface while being circulated in said drying vessel; and means provided in opposition to an upper end of said flat upper surface of said spiral blade for forcing said substance off the upper end of said flat upper surface to fall down through a falling space defined by said circulating rotary spiral blade.

2. A drying apparatus as set forth in claim 1, wherein said means for forcing said substance off the upper end of said spiral blade comprises a baffle plate provided in opposition with the upper end of said spiral blade with a given angular relationship thereto.

3. A drying apparatus as set forth in claim 2, wherein said baffle plate is provided in direct contact with said inner wall of said drying vessel.

4. An apparatus for removing the moisture content form a substance to be dried comprising:

a vessel for containing the substance, the vessel having a bottom, a top, and a heating wall capable of transferring heat from a heating medium to the substance; and means for moving the substance inside the vessel including:

a rotary shaft vertically extending inside the vessel, and a spiral blade of a given length connected to and wound around the rotary shaft, for transporting the substance near the bottom of the vessel to near the top of the vessel, the spiral blade having a flat upper surface and having an outer edge forming a gap with the heating wall; and means provided in opposition to an upper end of said flat upper surface of said spiral blade for forcing said substance off the upper end of said flat upper surface to fall down through a falling space defined by said circulating rotary spiral blade.

5. A drying apparatus as set forth in claim 4, wherein said means for forcing said substance off the upper end of said spiral blade comprises a baffle plate provided in opposition with the upper end of said spiral blade with a given angular relationship thereto.

6. A drying apparatus as set forth in claim 5, wherein said baffle plate is provided in direct contact with said inner wall of an drying vessel.

7. A drying apparatus for removing moisture content from a substance to be dried, comprising:

peripheral wall means defining a working space for drying the substance, said peripheral wall means defining at least an inlet for charging the substance to be dried and an outlet for taking the dried substance therefrom;

rotary spiral blade assembly disposed within said working space and having a lower end, at which the substance accumulated on a bottom of said working space rides on a transporting surface of said rotary spiral blade assembly, said rotary spiral blade assembly being rotatable at a predetermined rotation speed sufficient for forcing said substance on said transporting surface to climb up toward an upper end of said rotary spiral blade assembly, and said rotary spiral blade assembly defining a path for substance, reaching the upper end thereof, to fall down to the bottom;

heating means associated with at least one of the peripheral wall means and said rotary spiral blade assembly for heating a surface interfacing with the substance while said substance travels on said transported surface toward the upper end; and means located in opposition to the upper end of said rotary spiral blade assembly for forcing said substance reaching the upper end to fall down through said path, said means comprising at least one substantially flat plate member having a planar contact surface to contact with the substance conveyed on said transporting surface, said flat plate member being oriented in a substantially vertical position to extend across said transporting surface.

8. A drying apparatus as set forth in claim 7, wherein said means for forcing said substance to fall down comprises mechanical means for interfering travel of said substance.

9. A drying apparatus as set forth in claim 8, wherein said mechanical means is placed in proximity with said transporting surface with a necessary minimum clearance therebetween and extends across said transporting surface.

10. A drying apparatus as set forth in claim 9, wherein said mechanical means is a baffle plate.

11. A drying apparatus as set forth in claim 10, wherein said heating means heats at least said peripheral wall means and said baffle plate is directly mounted on said peripheral wall means.

12. A drying apparatus for removing moisture content from a substance to be dried, comprising:

peripheral wall means defining a working space for drying the substance, said peripheral wall means defining at least an inlet for charging the substance to be dried and an outlet for taking the dried substance therefrom;

rotary means disposed within said working space for defining an upward traveling path along which said substance travels from a bottom toward an upper end thereof by the action of force induced by rotation thereof, said upward traveling path having a lower end, at which the substance accumulated on the bottom of said working space rides thereon, said rotary means being rotatable at a predetermined rotation speed sufficient for forcing said substance on a transporting surface of the upward traveling path to climb up toward the upper end of said upward traveling path, and said rotary means defining a falling down path for substance, reaching the upward end thereof, to fall down to the bottom;

heating means associated with the peripheral wall means and said rotary means for heating surfaces interfacing with the substance while said substance travels on said upward traveling path; and means located in opposition to the upper end of said upward traveling path for forcing said substance reaching the upper end to fall down through said falling down path, said means comprising at least one substantially flat plate member having a planar contact surface to contact with the substance conveyed on said upward traveling path, said flat plate member being oriented in a substantially vertical position to extend across said traveling path, and said flat plate member having a radial length greater than the width of said traveling path.

13. A drying apparatus as set forth in claim 12, wherein said means for forcing said substance to fall down comprises mechanical means for interfering travel of said substance.

14. A drying apparatus as set forth in claim 13, wherein said mechanical means is placed in proximity with said transporting surface with a necessary minimum clearance therebetween and extends across said transporting surface.

15. A drying apparatus as set forth in claim 14, wherein said mechanical means is a baffle plate.

16. A drying apparatus as set forth in claim 15, wherein said heating means heats at least said peripheral wall means and said baffle plate is directly mounted on said peripheral wall means.

* * * * *